United States Patent [19]

Mallory

[11] Patent Number: 5,061,858

[45] Date of Patent: Oct. 29, 1991

[54] CASK ASSEMBLY FOR TRANSPORTING RADIOACTIVE MATERIAL OF DIFFERENT INTENSITIES

[75] Inventor: Charles W. Mallory, Severna Park, Md.

[73] Assignee: Westinghouse Electric Corp., Pittsburgh, Pa.

[21] Appl. No.: 109,527

[22] Filed: Oct. 19, 1987

[51] Int. Cl.[5] ..... G21F 5/00

[52] U.S. Cl. ..... 250/507.1; 250/506.1

[58] Field of Search ..... 250/506.1, 507.1; 376/272

[56] References Cited

U.S. PATENT DOCUMENTS

| | | | |
|---|---|---|---|
| Re. 29,876 | 1/1979 | Reese | 250/506.1 |
| 3,005,105 | 10/1961 | Lusk | 250/506.1 |
| 3,119,933 | 1/1964 | Allen | 250/506.1 |
| 3,206,015 | 9/1965 | Zimmer et al. | 206/46 |
| 3,575,601 | 4/1971 | Harwell | 376/272 |
| 3,587,700 | 6/1971 | Mauer | 220/85 |
| 3,675,746 | 7/1972 | Irvine | 206/46 |
| 3,747,799 | 7/1973 | Atkinson | 220/85 |
| 3,754,140 | 8/1973 | Beierie | 250/507.1 |
| 3,780,309 | 12/1973 | Bochard | 250/506.1 |
| 3,824,673 | 7/1974 | Wurm et al. | 29/403 |
| 3,851,179 | 11/1974 | Irvine | 250/506.1 |
| 3,886,368 | 5/1975 | Rollins et al. | 250/507.1 |
| 3,908,951 | 9/1975 | Goben | 248/358 |
| 3,962,587 | 6/1976 | Dufrane et al. | 250/506.1 |
| 4,100,860 | 7/1978 | Gablin et al. | 109/83 |
| 4,116,337 | 9/1978 | Backus | 206/591 |
| 4,147,938 | 4/1979 | Heckman et al. | 250/506.1 |
| 4,175,669 | 11/1979 | Housholder et al. | 220/5 |
| 4,190,160 | 2/1980 | Andersen et al. | 206/591 |
| 4,234,092 | 11/1980 | Axel | 206/523 |
| 4,268,755 | 5/1981 | Weber et al. | 250/506.1 |
| 4,292,528 | 9/1981 | Shaffer et al. | 250/506.1 |
| 4,292,901 | 10/1981 | Cox | 206/453 |
| 4,376,489 | 3/1983 | Clemens | 220/15 |
| 4,423,802 | 1/1984 | Botzem et al. | 188/377 |
| 4,435,358 | 3/1984 | Krieger | 376/272 |
| 4,445,042 | 4/1984 | Baatz et al. | 250/506.1 |
| 4,447,729 | 5/1984 | Doroszlai et al. | 250/506.1 |
| 4,447,730 | 5/1984 | Botzem et al. | 250/506.1 |
| 4,498,011 | 2/1985 | Dyck et al. | 250/507.1 |
| 4,528,454 | 7/1985 | Baatz et al. | 250/506.1 |
| 4,594,214 | 6/1986 | Popp et al. | 376/272 |
| 4,673,813 | 6/1987 | Sanchez | 376/272 |
| 4,738,388 | 4/1988 | Bienek et al. | 376/272 |
| 4,786,805 | 11/1988 | Priest | 250/260 |

FOREIGN PATENT DOCUMENTS

| | | | |
|---|---|---|---|
| 2748391 | 5/1979 | Fed. Rep. of Germany | 250/506.1 |

OTHER PUBLICATIONS

Defense High Level Waste (DHLW)/Defense Generated Remote Handled Transuranic Waste (RH TRU) Dual Purpose Cask, Submitted to U. S. Department of Energy, in Response to: RFP No. DE-RP04-8-6AL33569.

*Primary Examiner*—Jack I. Berman

[57] ABSTRACT

An improved cask assembly for forming a cask that is adapted to transport radioactive materials of a particular activity is disclosed herein. The cask assembly comprises an outer container having an opening leading to its interior, and a plurality of inner shield inserts, each of which includes an inner wall whose shape is substantially complementary to the shape of the interior of the outer container and which is insertable therein to form a cask. The exterior walls of the inner shield inserts are formed from different shielding compositions, such as depleted uranium or lead, and are also of different thicknesses. The particular shield inserted within the interior of the outer container is chosen to match the intensity and type of radiation emitted by the waste to be transported so that the assembled cask hold a maximum amount of the particular material to be transported without exceeding a surface radiation of 200 millirems at any point. To facilitate the insertion and removal of the shield inserts, the closure opening is at least as wide as the width of its interior. Either a screw-type closure means of a breech-lock closure means is used to seal the container opening.

21 Claims, 7 Drawing Sheets

CASK ASSEMBLY FOR TRANSPORTING RADIOACTIVE MATERIAL OF DIFFERENT INTENSITIES

BACKGROUND OF THE INVENTION

This invention generally relates to casks for transporting radioactive materials, and is specifically concerned with an improved cask assembly for forming a cask adapted to transport a maximum amount of radioactive material of a particular activity within a given weight limit.

Casks for transporting radioactive materials such as the waste products produced by nuclear power plant facilities are known in the prior art. The purpose of such casks is to ship radioactive wastes in as safe a manner as possible. Such casks may be used, for example, to ship high-level vitrified waste cannisters to a permanent waste isolation site or spent fuel rods to a reprocessing facility. At the present time, relatively few of such transportation casks have been manufactured and used since most of the spent fuel and other wastes generated by nuclear power plants are being stored at the reactor facilities themselves. However, the availability of such on-site storage space is steadily diminishing as an increasing amount of fuel assemblies and other wastes are loaded into the spent-fuel pools of these facilities. Additionally, the U.S. Department of Energy (D.O.E.) has been recently obligated, by way of the National Waste Policy Act of 1983, to move the spent-fuel assemblies from the on-site storage facilities of all nuclear power plants to a federally operated nuclear waste disposal facility starting in 1998.

While the transportation casks of the prior art are generally capable of safely transporting wastes such as spent fuel to a final destination, the applicant has observed that there is considerable room for improvement, particularly With respect to vehicle-drawn, Type B casks. Specifically, the applicant has observed that, in many instances, the structure of these casks do not lend themselves to an optimal loading of radioactive wastes. The resulting less-than-optimum loading necessitates a larger number of trips by the shipper in order to complete the transportation of a given amount of radioactive waste, thus increasing both the time and the cost of transport. However, before the problems associated with optimizing the amount of waste carried by a particular cask may be fully appreciated, some understanding of the constraints imposed by NRC regulations is necessary.

U.S. Department of Transportation (DOT) and state highway regulations limit the gross weight of the waste-carrying road vehicle to about 80,000 pounds for shipments without special permits. Since the typical tractor and trailer weighs approximately 30,000 pounds, the weight of a cask and its contents must not exceed approximately 50,000 pounds. These same regulations specify that the surface radiation of such cask be no greater than 200 millirems at any given point, and that the radiation emitted by the cask be no greater than ten millirems at a distance of two meters from the vehicle. Other DOT regulations require that the cask be capable of sustaining impact stresses of up to ten Gs in the longitudinal direction, five Gs in the lateral direction, and two Gs in the vertical direction without yielding the wastes. The end result of these regulations is that much of the 50,000 pounds must be expended in providing adequate shielding materials within the cask (which are usually formed from dense materials such as lead or depleted uranium), as well as a structurally strong outer shell that can withstand the designated impact stresses. The thicknesses of both the shielding material and the structural shell required to comply with federal regulations leaves only a relatively small amount of space in the center of the cask which can actually be used to contain and transport radioactive waste. To maximize the amount of carrying volume, the most effective shielding materials known are frequently integrated into the walls of the cask structure. Such materials include lead, depleted uranium, and tungsten. However, as these materials are of a very high density, the radius of the cask walls cannot be made too large, or the gross weight limitation of 50,000 pounds of the combination of cask and waste material will be exceeded. The end result of the foregoing constraints of structural strength, shielding effectiveness, and the density of the most effective known shielding materials renders the carrying space in such cask relatively small relative to the volume of the cask as a whole when high activity wastes such as spent fuel rods are being transported.

If the cost of transporting a particular amount of radioactive waste is to be minimized, then the use of the carrying space within the cask must be maximized, i.e., the space must be completely filled up with a waste having an activity which brings the surface radiation of the cask, as a whole, to just under the 200 millirem limit. If the carrying space within the cask is completely filled with a waste, but the resulting surface radiation of the cask is substantially below 200 millirems per hour, then the use of the cask is not being optimized. In such a case, a cask having thinner walls with less shielding materials and a larger cavity would be the optimum choice for the transportation of such a waste. If, on the other hand, only a small amount of the carrying volume may be filled with a particular kind of waste before the surface radiation of the case reaches 200 millirems, then the large ring of air-space between the waste and the shielding material results in a highly ineffective shielding geometry, wherein an excessively large weight of shielding material is being used to comply with the surface radiation limit of 200 millirems. In short, there is a single, optimum activity that every static-walled, prior art cask is matched to. Nuclear waste having an activity which is substantially below or above this optimum activity results in significant inefficiencies wherein the ratio of cask weight to waste weight is considerably higher than desired.

Clearly, what is needed is a cask capable of optimally adjusting both the type and the amount of shielding materials contained within its walls to the particular type and activity of the waste material being hauled. Ideally, such a cask should be capable of quickly and conveniently adjusting the type and thickness of the shield materials used in its walls which are difficult to fabricate and machine, such as depleted uranium or tungsten. Finally, such a cask should be relatively simple and inexpensive to fabricate, and some sort of means for easily opening and closing the cask to effect loading and unloading operations, as well as a mechanism for reliably venting, purging, and draining the interior of the cask regardless of the particular type and thickness of shielding used in the cask interior.

SUMMARY OF THE INVENTION

Generally, the invention is an improved cask assembly for forming a cask adapted to transport a radioactive material of a particular activity. The improved cask assembly comprises an outer container having an opening leading to its interior, and a plurality of inner shield inserts, each of which includes an exterior wall whose shape is substantially complimentary to the shape of the interior of the outer container and which is insertable therein to form a cask. The exterior walls of the different inserts are formed from different shielding compositions, and may be of different thicknesses, and the particular shield insert placed within, the interior of the outer container is chosen to match the intensity and type of radiation emitted by the waste to be transported so that maximum amount of waste is loaded into the cask without exceeding the 200 millirem surface radiation limit.

To handle wastes emitting high levels of gamma radiation, at least one of the inner shield inserts preferably includes a layer of depleted uranium. To handle wastes emitting neutrons, at least one of the inner shield inserts includes a layer of lead or boro-silicone or other neutron attenuating or absorbing material. Both the inner wall of the outer container and the outer wall of the insert is preferably lined with non-corrosive metal, such as stainless steel.

To facilitate the insertion and removal of the different shield inserts and the radioactive materials contained therein, the access opening of the outer container is equal to or greater than the width of the interior. Additionally, a screw-type, double-lidded closure means may be used to selectively open and close both the outer container and the shield insert. Such a screw-type closure means includes an outer lid circumscribed by screw threads that are engageable with screw threads present around the access opening of both the container and the insert, as well as an inner lid circumscribed by a gasket that seats onto a ledge that circumscribes the opening. Alternatively, an improved, double-lidded breech-lock closure means may be used which includes an inner lid that is rotatably connected to an outer lid. As is the case with the screw-type closure means, the inner lid is circumscribed by a gasket which seats around a ledge which circumscribes the closure opening. However, instead of threads, the outer lid includes a plurality of flanges which are insertable between flanges which circumscribe the closure opening and which are further rotatable therebehind. Both closures allow the outer container and shield inserts to be closed and sealed without any rubbing between the gasket and the ledges surrounding the opening of these vessel. Of the two types of closures, the improved breech-lock closure is preferred since it is easier to machine, and effects a seal with a minimal amount of rotation between the outer lid and the outer container or shield insert.

The outer container of the improved cask assembly may include a vent, purge, and drain assembly mounted in the side wall thereof. The primary purpose of this assembly is to allow the seal effected by the closure to be checked for leakage. This assembly may in turn include a drain pipe and a vent pipe and plugs removably insertable in each pipe. A drain tube that fits into a groove provided in the inner walls of the outer container may also be provided for draining any liquids that collect on the floor of the container. The drain tube may communicate with the drain pipe by way of a fitting. Such a configuration renders the vent, purge, and drain assembly effective regardless of the type of shield insert used in conjunction with the outer container.

BRIEF DESCRIPTION OF THE SEVERAL FIGURES

Figure 6A:
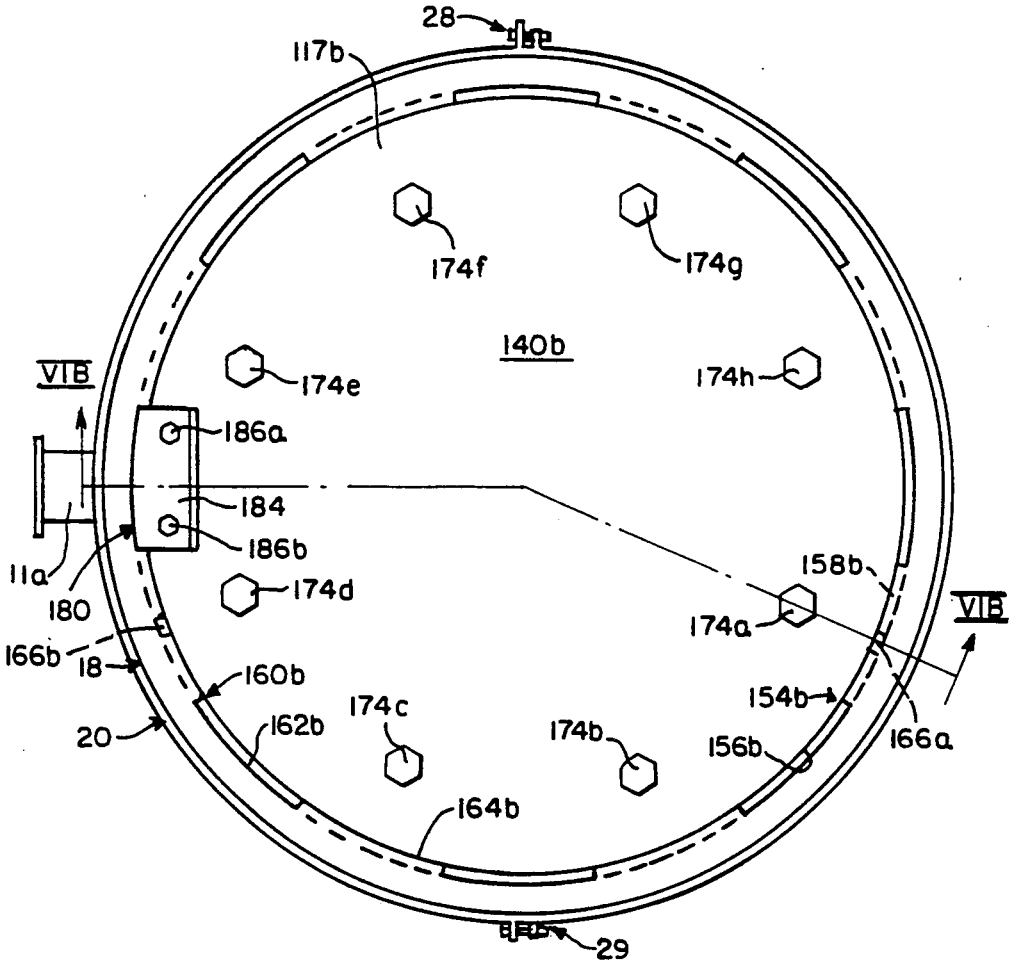
FIG. 6A is a plan view of a breech-lock, double-lidded closure that may be used to close and seal both the shield insert and the outer container.
Figure 6B:
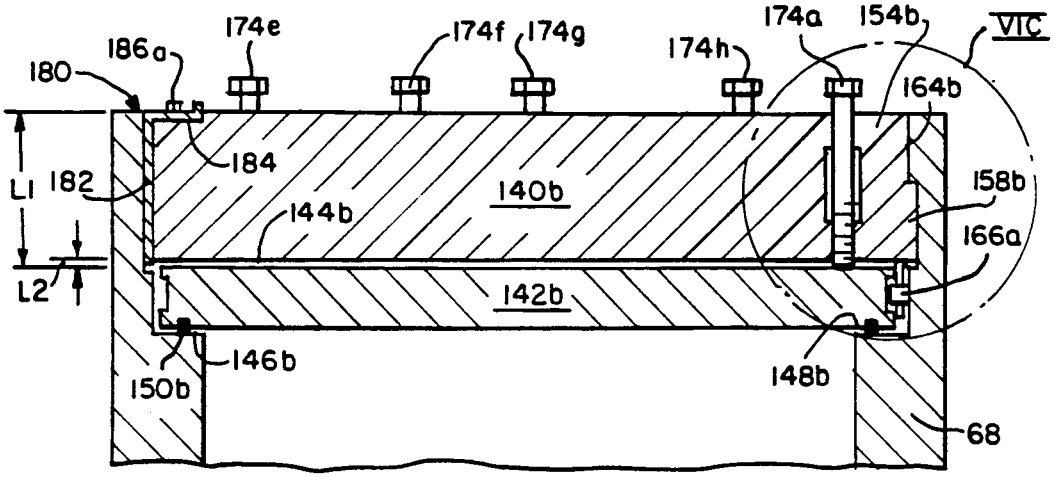
Figure 6C:
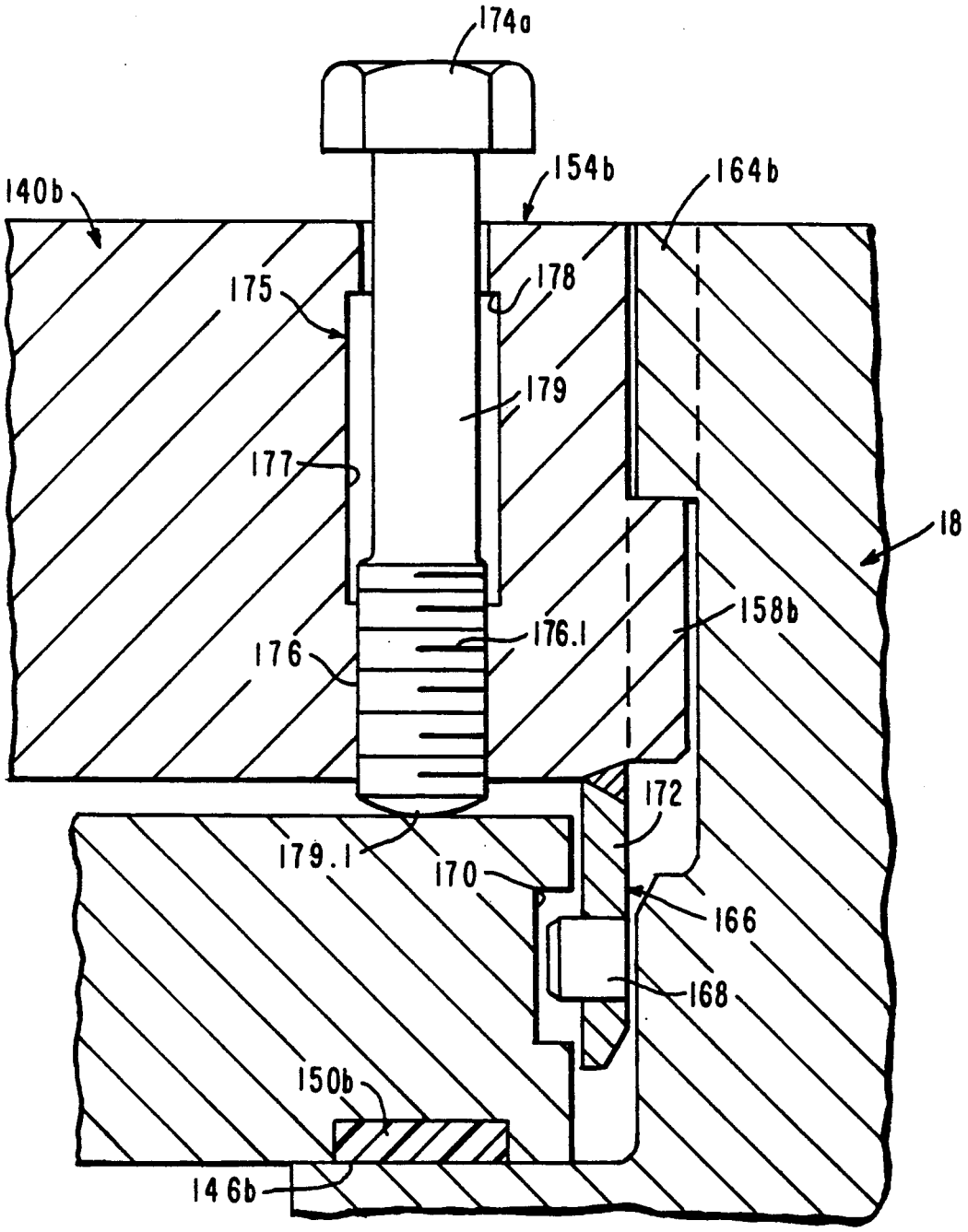

FIG. 6B is a cross sectional view of the closure illustrated in FIG. 6A along the lines 6B—6B, and FIG. 6C is an enlarged view of the area encompassed within the circle in FIG. 6B, illustrating how the flanges and notches which inner edge of the access opening of the outer container interfit with one another, and further illustrating how the sealing bolts sealingly engage the gasket of the inner lid around this opening.

DETAILED DESCRIPTION OF THE PREFERRED EMBODIMENT

Figure 1:
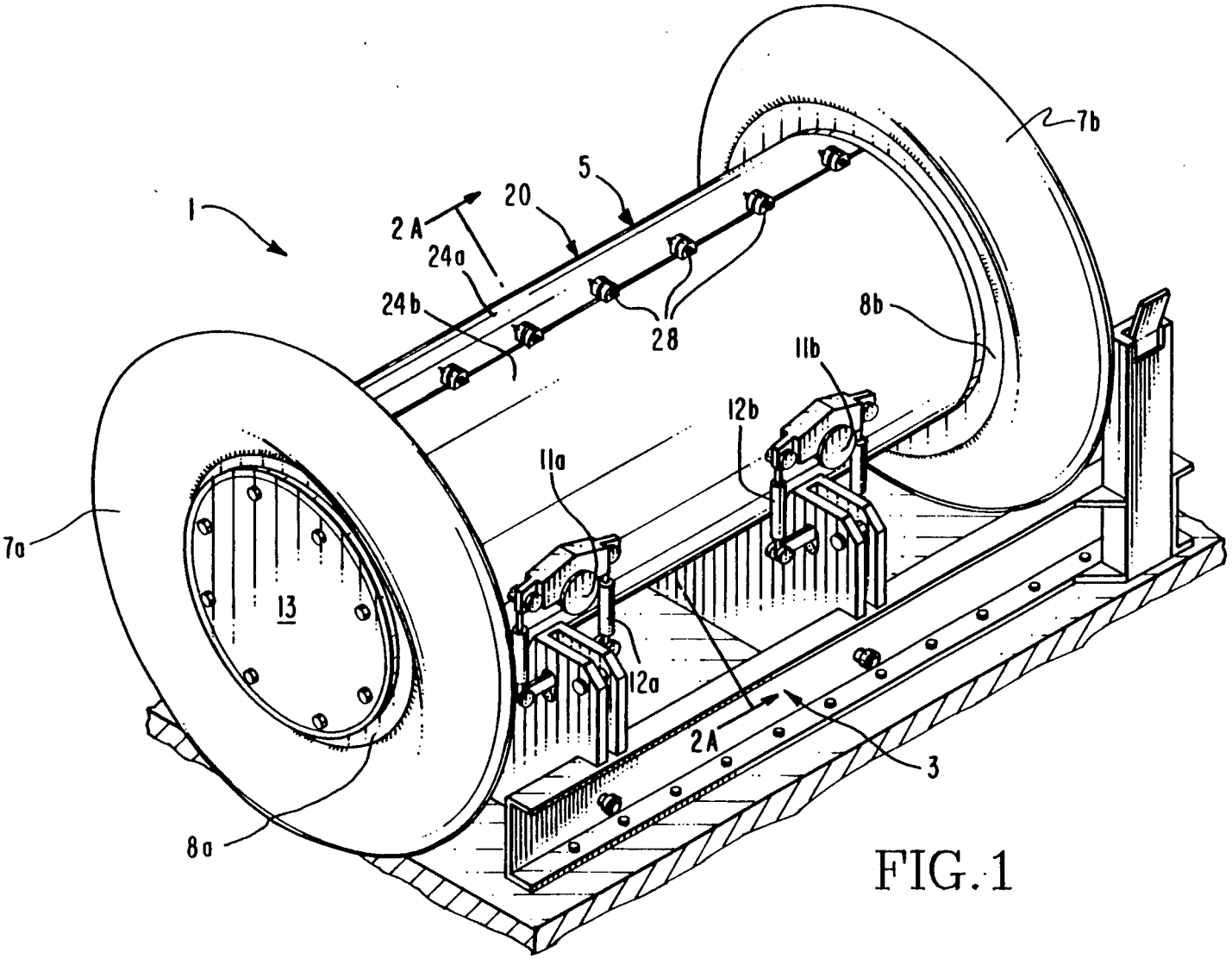
FIG. 1 is a perspective view of the improved cask assembly of the invention as it would appear mounted in a biaxial restraint cradle.
Figure 3:
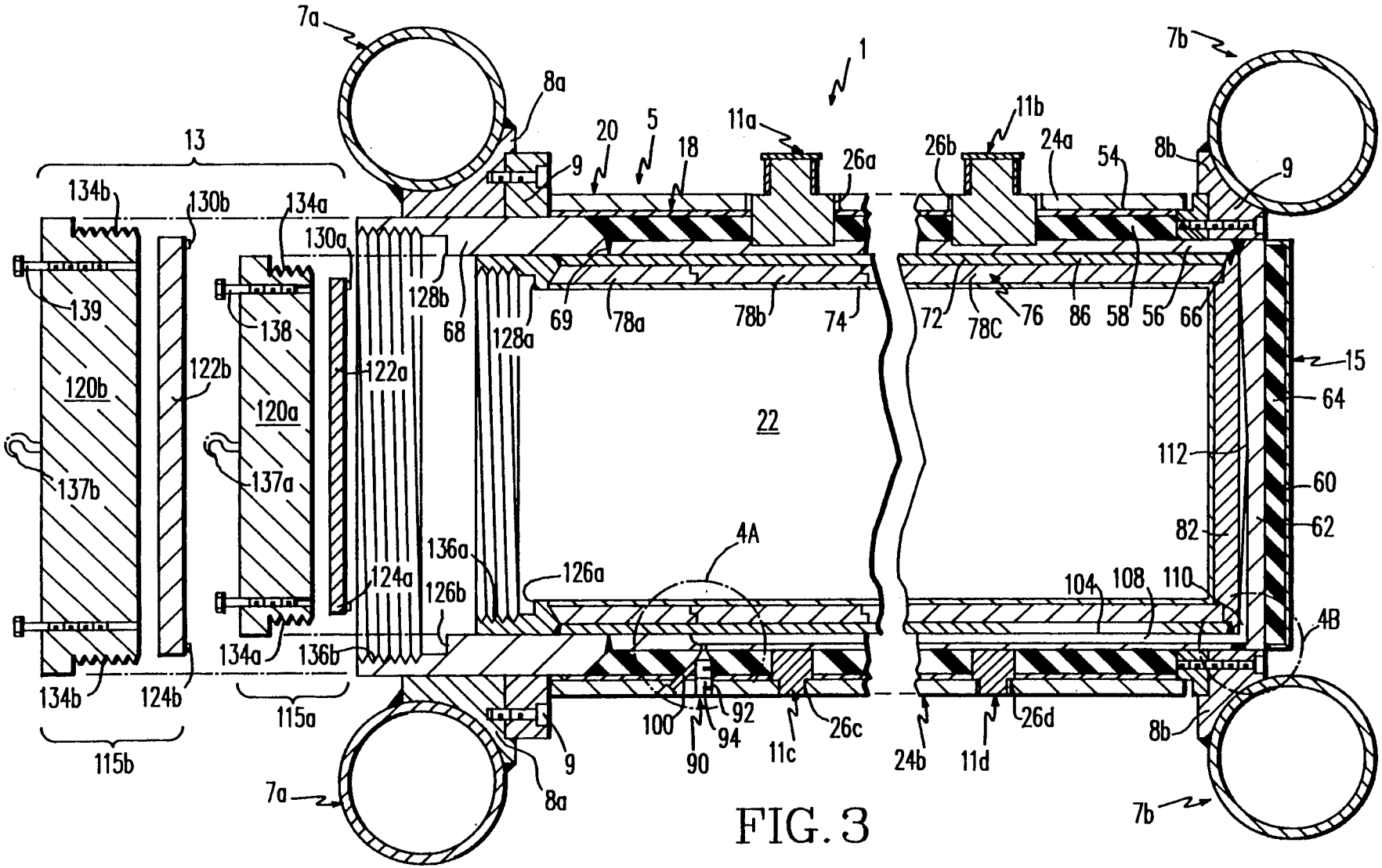
FIG. 3 is a cross sectional side view of the cask assembly, showing how one of the shield inserts slidably fits into the interior of the outer container, and how screw-type, double-lidded closures (shown in exploded form) may be used to close and seal both the shield insert and the outer container.
Figure 5:
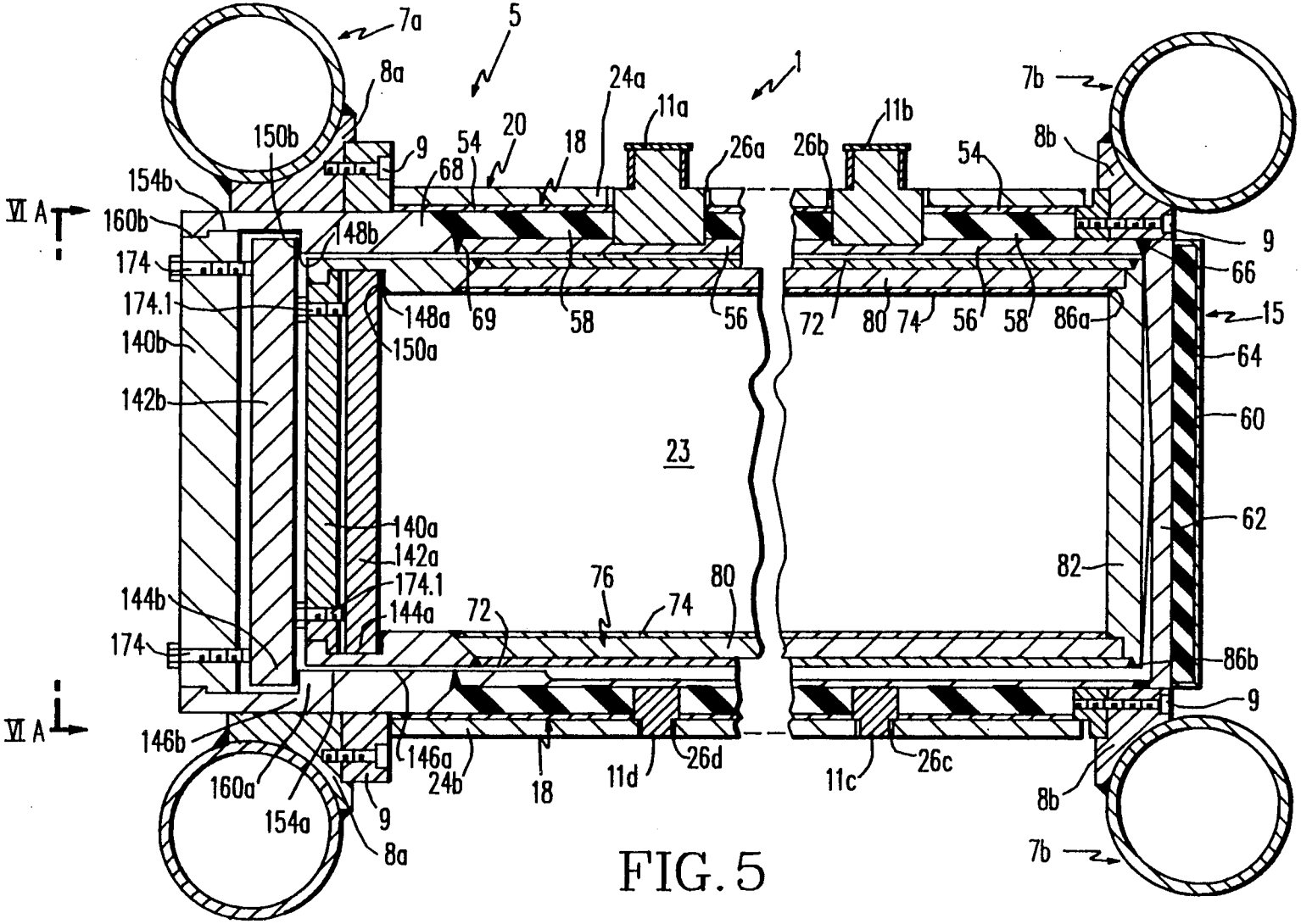
FIG. 5 is a cross sectional side view of the improved cask assembly of the invention, showing an alternative shield insert disposed within the interior of the outer container that is particularly well suited for carrying neutron-emitting radioactive materials.

With reference now to FIG. 1, wherein like numerals designate like components throughout all the several figures, the invention is a cask assembly 1 that is particularly useful in carrying radioactive materials of different activities aboard a vehicle such as a tractor-trailer. In use, the cask assembly is typically mounted within a novel biaxial restraint cradle 3, which in turn is secured onto the trailer of a tractor-trailer (not shown). Generally, the cask assembly itself has a cylindrical body 5 which is circumscribed on either end by toroidial impact limiters *7a*, and *7b*. Each of these impact limiters *7a*, *7b* is a donut-shaped shell of yieldable aluminum which is approximately one-half of an inch thick. Each of the toroidial impact limiters 7*a*, 7*b* is mounted around its respective end of the cylindrical body 5 by means of a support ring assembly 8*a*, 8*b* which in turn is secured to the cylindrical body 5 by a plurality of bolts 9. Disposed between the impact limiters 7*a*, 7*b* are a pair of opposing trunnions 11*a*, 11*b* and 11*c*, 11*d*. The two pairs of trunnions are disposed 180 degrees apart around the cylindrical body 5 of the cask assembly 1, and are receivable within two pairs of turn buckle assemblies 12*a*, 12*b*, and 12*c* (of which only 12*a* and 12*b* are visible) that form part of the cradle 3. The cylindrical body 5 is capped by a closure 13 at one end, and an end plate assembly 15 (shown in FIG. 3) at the other end. As is best seen in FIGS. 3 and 5, the cylindrical body 5 of the cask assembly 1 is generally formed by an outer container 18 which is surrounded by a thermal protection shell 20 on its exterior, and which contains in its interior one of two different shield inserts 22 or 23, depending upon the activity and type of radiation emitted by the material to be transported. While only two specific types of shield inserts 22 and 23 are specifically disclosed herein, it should be noted that the inserts 22 and 23 are merely exemplary, and that the improved cask assembly may in fact be used with any number of different types of shield inserts formed of different shielding materials and of different wall thicknesses for handling radioactive material within a broad range of activity and radiation type.

Figure 2A:
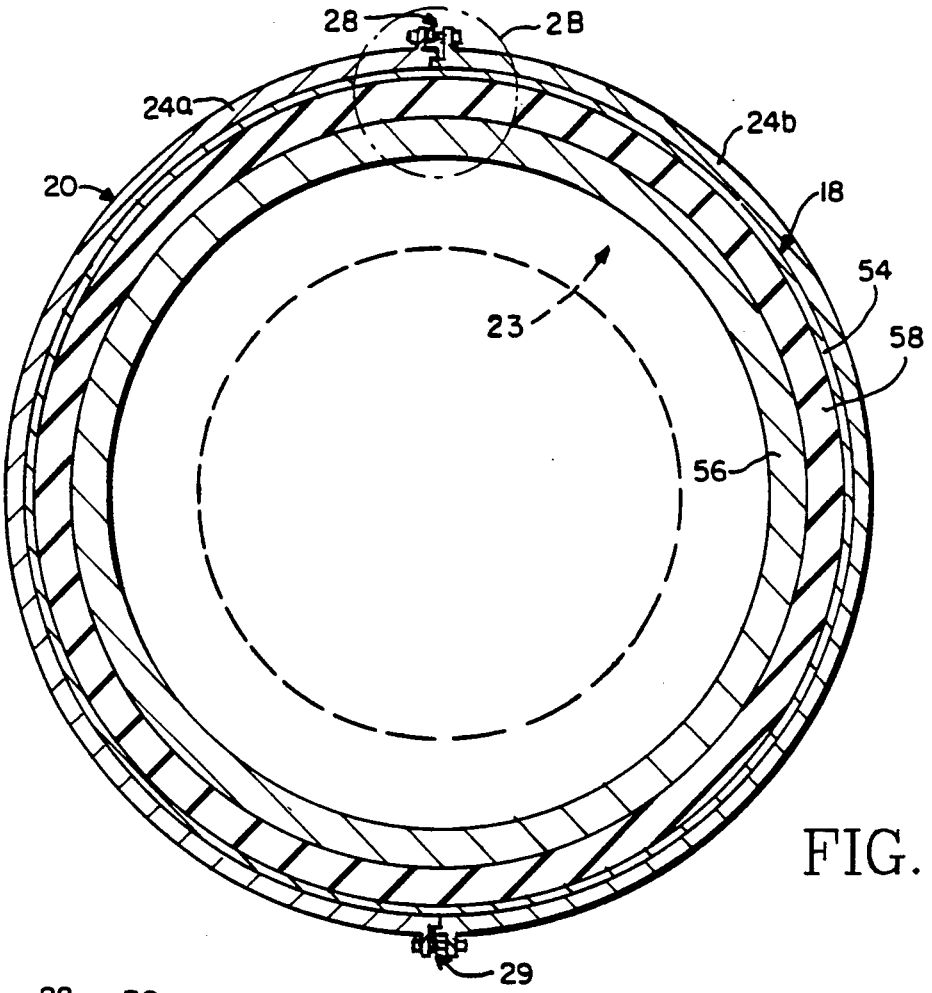
FIG. 2A is a cross sectional view of the improved cask assembly illustrated in FIG. 1 along the line 2A—2A with the toroidal impact limiters removed.
Figure 2B:
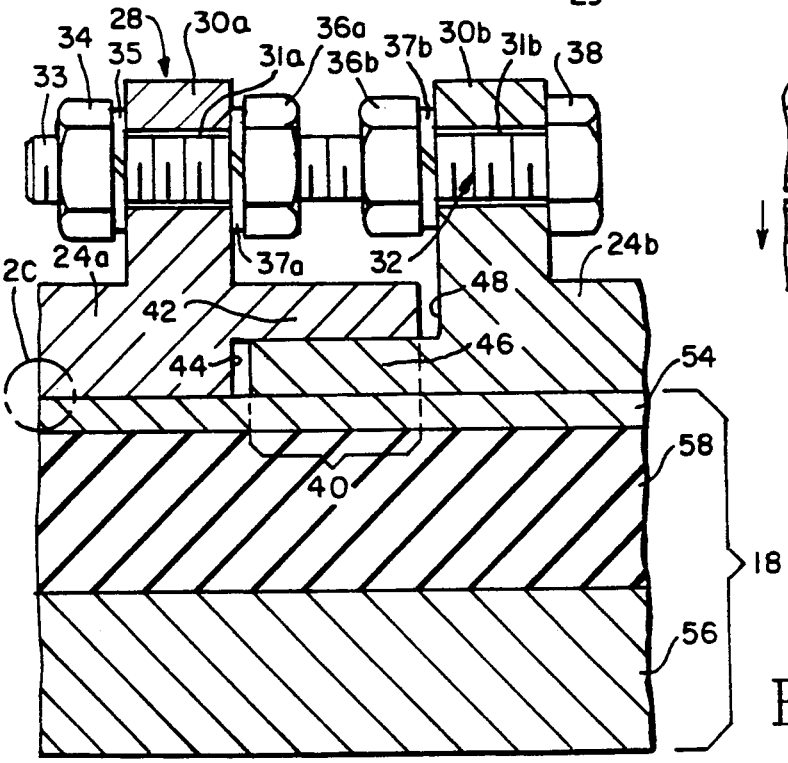
FIG. 2B is an enlarged, cross sectional view of the connecting assembly circled in FIG. 2A which rigidly interconnects the semi-cylindrical sections that form a thermal protection shell for the cask assembly.
Figure 2C:
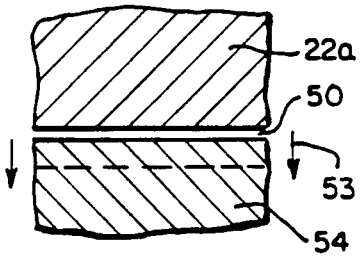
FIG. 2C is an enlargement of the area circled in FIG. 2B, demonstrating how the distance between the outer surface of the outer container and the inner surface of the thermal protection shell increases when the shell is exposed to a source of thermal radiation such as a fire.

With reference now to FIGS. 2A, 2B, and 2C, the thermal protection shell 20 which circumscribes the outer container 18 of the cask assembly 1 is formed from a pair of semi-cylindrical shell sections 24*a*, 24*b* which are rigidly interconnectable into thermal contact with one another. Each of the shell sections 24*a*, 24*b* includes a pair of cut-outs 26 for admitting the trunnions 11*a*, 11*b*, 11*c*, and 11*d*. Each of the shell sections 24*a*, 24*b* is formed from a metal having a thermal coefficient of expansion which is greater than that of the metal that forms the walls of the outer container 18, and which is at least as heat-conductive as the metal which forms the walls 54 of the outer container 18. When the outer wall of the outer container 18 is formed from steel, the shell sections 24*a*, 24*b* are preferably formed from aluminum or magnesium or an alloy of either or both of these metals. The coefficient of thermal expansion of these metals is approximately twice that of the thermal coefficient of expansion of steel. Moreover, the high coefficient of thermal conductivity of each such metal insures that the thermal protection shell 20 will not significantly obstruct the conduction of decay heat conducted through the walls of the outer container 18 which is generated by the radioactive material held within the cask assembly 1. When the diameter of the outer container 18 is between forty and sixty inches, a wall thickness of approximately one-half of an inch is preferred for both of the shell sections 24*a*, 24*b*. Such a wall thickness renders the thermal protection shell 20, as a whole, thin enough to be conveniently retrofitted over many existing transportation casks without significantly adding to the weight thereof, yet is thick enough to maintain the structural integrity needed to expand away from the outer walls of the outer container when exposed to a source of intense thermal radiation, such as a fire. Finally, the preferred thickness of one-half of an inch provides enough mass to give the entire thermal protection shell 20 a significant latent heat of fusion, which will provide still more thermal protection through ablation should the cask 1 be exposed to intense heat.

A plurality of top and bottom connecting assemblies 28, 29 are used to rigidly interconnect the two semi-cylindrical shell sections 24*a*, 24*b*. Since each of the connecting assemblies 28, 29 are identical in structure, a description will be made only of the top connecting assembly 28 circled in FIG. 2A.

This connecting assembly 28 is formed from a pair of opposing semicircular lugs 30*a* and 30*b* which are integrally formed along the edges of the shell sections 24*a* and 24*b* respectively. These lugs 30*a*, 30*b* include mutually alignable bore holes 31*a* and 31*b* for receiving a connecting bolt 32. The threaded end 33 of the bolt 32 is engaged to a tension nut 34 as shown in FIG. 2B. The distance between the two lugs 30*a*, 30*b* (and hence the distance between the edges of the shell sections 24*a*, 24*b*) is largely determined by the extent of which the end 33 of the bolt 32 is threaded through the tension nut 34. A lock washer 35 is disposed between the tension nut 34 and the lug 30*a* to prevent the nut 34 from becoming inadvertently loosened. A pair of lock nuts 36*a*, 36*b* are threadedly engaged near the center portion of the connecting bolt 32 between the two lugs 30*a* and 30*b*. These lock nuts provide two functions. First, when properly adjusted, they prevent the tension nut 34 from applying excess tensile forces between the two shell sections 24*a* and 24*b* which might interfere with their expansion away from the outer container 18 in the event the cask assembly is exposed to a fire or other source of intense heat. Second, the nuts 36*a*, 36*b* eliminate all slack or play between the lugs 30*a*, 30*b*, thus insuring that the connecting assembly 28 rigidly interconnects the two shield sections 30*a*, 30*b*. Again, lock washers 37*a*, 37*b* are disposed between the lock nuts 36*a* and 36*b* and their respective lugs 30*a* and 30*b* to prevent any inadvertent loosening from occurring.

An overlap 40 is provided between the edges of the two shell sections 24*a* and 24*b* to establish ample thermal contact and hence thermal conductivity between these shell sections. The overlap 40 is formed from an outer flange 42 and recess 44 provided along the edge of shell section 24*a* which interfits with a complementary outer flange 46 and recess 48 provided along the opposing edge of shield section 24*b*. The actual length of the overlap 40 will vary depending upon the distance between the two lugs 30*a* and 30*b* as adjusted by the bolt 32, tension nut 34, and lock nuts 36*a* and 36*b*.

In operation, the two sections 24*a*, 24*b* of the thermal protection shell 20 are installed over the cask assembly 1 by aligning the various cutouts 26*a*, 26*b*, 26*c*, and 26*d* with the corresponding trunnions of 11*a*, 11*b*, 11*c*, and 11*d* which project from the cylindrical body 5, and placing the sections 24*a*, 24*b* together so that the lugs 30*a* and 30*b* of each of the connecting assemblies 28, 29 are in alignment with one another and the flanges and recesses 42, 44, and 48, 46 of each overlaps 40 are interfitted. Next, the bolt 32, tension nut 35, lock nuts 36*a*, 36*b*, and lock washers 35, 37*a*, and 37*b* are installed in their proper positions with respect to the lugs 30*a*, 30*b* of each of the connecting assemblies 28, 29. The tension nut 34 is then screwed over the threaded end 33 of connecting bolt 32 until the interior surface of each of the shell sections 24*a* and 24*b* is pulled into intimate thermal contact with the outside wall 54 of the outer container 18. In the preferred method of installing the thermal protection shield, the tension nut 34 of each of the connecting assemblies 28, 29 is initially torqued to a selected maximum on the threaded shaft of the bolt 32 until the nut 34 imparts a significant tensile force between the two lugs 30*a* and 30*b*. This tensile force tends to squeeze the two shell sections 24*a* and 24*b* together around the outer wall 54 of the outer container 18 in a clamp-like fashion, which in turn removes any significant gaps between the outer surface of the wall 54 and the inner surface of the shell sections 24*a* and 24*b* by bending these sections into conformity with one another. In the next step, each of the nuts 34 is relaxed enough to prevent these tensile clamping forces from interfering with the expansion of the thermal protection shell 20 in the event of a fire, yet not so much as to cause the surfaces of the shell 20 and the outer container from becoming disengaged with one another. Thereafter, the lock nuts 36*a* and 36*b* are tightened against the faces of their respective lugs 30*a* and 30*b* to remove all slack in each connecting assembly 28, 29. The end result is a rigid interconnection between opposing edges of the shield sections 24*a* and 24*b*, wherein each of the opposing lugs 30*a* and 30*b* is tightly sandwiched between the tension nut 34 and lock nut 36*a*, or the head of the bolt 38 and lock nut 36*b*, respectively.

If the outer container has no trunnions 11*a*, 11*b*, 11*c*, 11*d*, or other structural members which would prevent the surfaces of the shell 20 and outer container 18 from coming into intimate thermal contact, the shell 20 may assume the form of a tubular sleeve which may be, in effect, heat shrunk into contact over the container 18. This alternative method of installation comprises the steps removing the impact limiters 7*a*, 7*b*, of heating the shell to a temperature sufficient to radially expand it, sliding it over the wall 54 of the outer container 18, allowing it to cool and contract into intimate thermal contact with the wall 54, and reinstalling the impact limiters 7*a*, 7*b*.

FIG. 2C illustrates the typical gap condition between the inner surface of the thermal protection shell 20 and the outer surface of the outer container 18. Under ambient conditions, these two opposing surfaces are either in direct contact with one another, or separated by only a tiny gap 50 which may be as much as one mil. Such a one mil separation at various points around the cask assembly 1 does not significantly interfere with the conduction of heat between the wall 54 of outer cask 18, and the thermal protection shell 20. However, when the cask assembly 1 is exposed to a source of intense thermal radiation such as a fire, the. substantially higher thermal coefficient of expansion of the aluminum or magnesium forming the shell 20 will cause it to expand radially away from the outer surface of the outer container 18, leaving an air gap 53 (shown in phantom) between the two surfaces. Moreover, since the thermal protection shield 20 is formed from a metal having good heat conductive properties, this differential thermal expansion is substantially uniform throughout the entire circumference of the shield 20, which means that the resulting insulatory air gap 53 is likewise substantially uniform. When this gap exceeds approximately two and one-half mils, the primary mode of heat transfer switches from conductive and convective to radioactive. Thus the three mil gap provides a substantial thermal resistor between the fire or other source of intense infrared radiation in the outer container 18 of the cask 1.

With reference now to FIGS. 3, 4A, 4B, and 5, the side walls of the outer container 18 of the improved cask 1 are a laminate formed from the previously mentioned outer wall 54, an inner wall 56, and a center layer 58 of shielding material. In the preferred embodiment, the outer wall 54 is formed from low alloy steel approximately one-forth of an inch thick. Such steel is economical, easy to manufacture, and a reasonably good conductor of heat. In the alternative, stainless steel may be used in lieu of low alloy steel. While the use of stainless steel would be more expensive, it provides the additional advantage of corrosion-resistance. The inner wall 56 is preferably also formed from low alloy steel. However, the inner wall 56 is made two inches thick in order to provide ample structural rigidity and strength to the outer container 18. Disposed between the outer wall 54 and the inner wall 56 is a layer of Boro-Silicone This material advantageously absorbs neutrons from neutron-emitting radioactive materials (such as transuronic elements), and further is a relatively good conductor of heat. It is a rubbery material easily cast, and may be melted and poured between the inner and outer walls 54, 56 of the outer container 18 during its manufacture. Boro-Silicone is available from Reactor Experiments, Inc., and is a registered trademark of this corporation.

The bottom of the outer container 18 is formed by an end plate assembly 15 that includes an outer plate 60, an inner plate 62, and a layer of center shielding material 64. In the preferred embodiment, the outer plate 60 is again formed from a low alloy steel approximately one-forth inch thick. The inner plate 62, like the inner wall 56, is again formed from a layer of low alloy steel approximately two inches thick. The center shielding material 64 is again preferably Boro-Silicone for all the reasons mentioned in connection with the center shielding material 58 of the side walls of the container 18. The low alloy steel inner plate 62 is joined around the bottom edge of the inner wall 56*a* 360° via weld joint 66. The top of the outer container 18 includes a forged ring of low alloy steel 68. This ring 68 is preferably four inches thick throughout its length, and is integrally connected to the inner wall 56 of the container 18 by a 360° weld joint 69. The upper edge of the ring 68 is either threaded or stepped to accommodate one of the two types of improved closures 115*b* or 117*b*, as will be explained in detail hereinafter.

With specific reference now to FIGS. 3 and 5, the cask assembly 1 is formed from the outer container 18 and shell 20 in combination with one of two different shield inserts 22 (illustrated in FIG. 3) or 23 (illustrated in FIG. 5). Each of the shield inserts 22, 23 is formed from an outer cylindrical wall 72 which is preferably one inch thick and a cylindrical inner wall 74 which is approximately one-fourth of an inch thick. Both walls are formed from A1 S1 304 stainless steel. The corrosion resistance of stainless steel prevents the outer dimensions of the outer wall 74 from becoming distorted as a result of rust, which in turn helps advantageously to maintain a relatively tight, slack-free fit between the shield inserts 22, 23 and the interior of the outer container 18.

Each of the shield inserts 22 and 23 includes a layer of shielding material 76 between their respective outer and inner walls 72, 74. However, in shield insert 22, this shielding material is formed from a plurality of ring-like sections 78*a*, 78*b*, and 78*c* of either depleted uranium or tungsten. These materials have excellent gamma shielding properties, and are particularly well adapted to contain and shield radioactive material emitting high intensity gamma radiation. Of course, a single tubular layer of depleted uranium or tungsten could be used in lieu of the three stacked ring-like sections 78*a*, 78*b*, and 78c. However, the use of stacked ring-like sections is preferred due to the difficulty of fabricating and machining these metals. To effectively avoid radiation streaming at the junctions between the three sections, overlapping tongue and groove joints 79 (see FIG. 4A) are provided at each junction . By contrast, in shield insert 23, a layer of poured lead 80 is used as the shielding material 76. While lead is not as effective a gamma shield as depleted uranium, it is a better material to use in connection with high-neutron emitting materials, such as the transuranic elements. Such high neutron emitters can induce secondary neutron emission when depleted uranium is used as a shielding material. While such a secondary neutron emission is not a problem with tungsten, this metal is far more difficult and expensive to fabricate than lead, and is only marginally better as a gamma-absorber. Therefore, lead is a preferred shielding material when high-neutron emitting materials are to be transported. It should be noted that the radius of the interior of the shield inserts 22 and 23 will be custom dimensioned with a particular type of waste to be transported so that the inner wall 74 of the insert comes as close as possible into contact with the radioactive material contained therein. The Applicant has noted that fulfillment of the foregoing criteria provides the most effective shielding configuration per weight of shielding material. Additionally, the thickness and type of shielding material 76 will be adjusted in accordance with the activity of the material contained within the shield insert 22, 23 so that the surface radiation of the cask assembly 1 never exceeds 200 mr. The fulfillment of these two criteria maximizes the capacity of the cask assembly 1 to carry radioactive materials while simultaneously minimizing the weight of the cask.

Figure 4B:
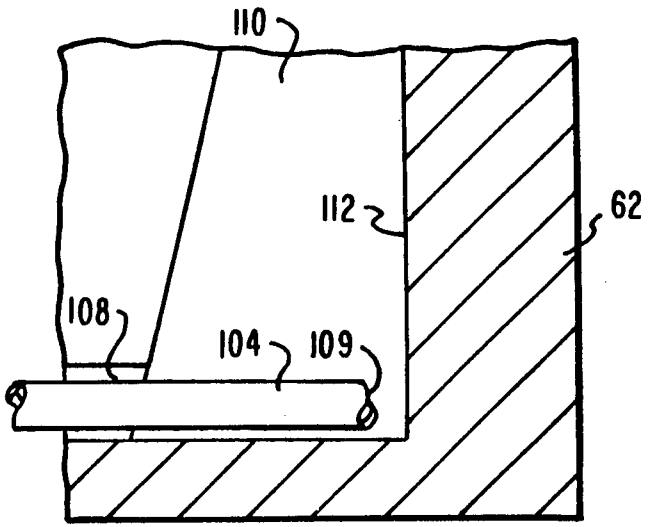
FIG. 4B is a cross sectional side view of the area encompassed within the lower circle in FIG. 3, showing how the bottom end of the drain tube fits into a fluid conducting groove cut into the conical bottom of the outer container of the cask assembly.
Figure 4A:
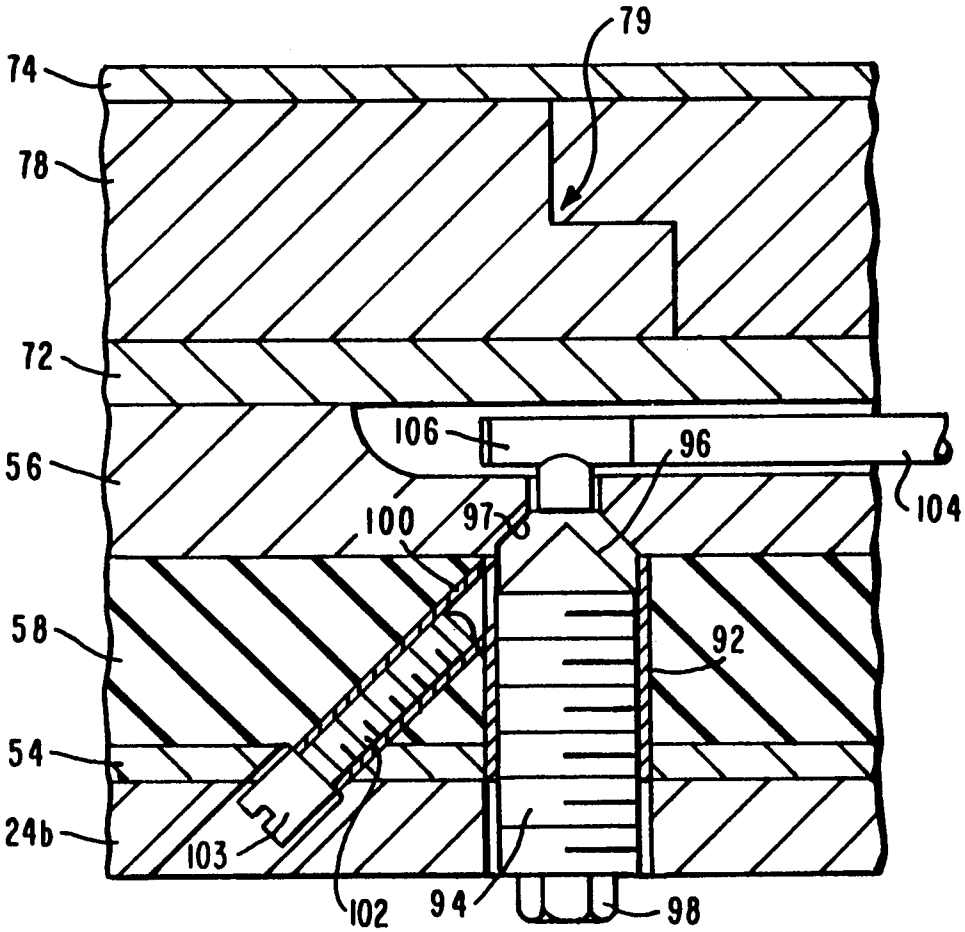
FIG. 4A is an enlarged cross sectional side view of the vent, purge, and drain assembly circled in FIG. 3, showing the drain pipe, the vent pipe, the drain and vent plugs, and the drain tube thereof.

FIGS. 4A and 4B illustrate the vent, purge, and drain assembly 90 of the outer container 18. This assembly 90 includes a threaded drain pipe 92 for receiving a drain plug 94. The inner end 96 of the drain plug 94 is conically shaped and seatable in sealing engagement with a complementary valve seat 97 located at the inner end of the pipe 92. Wrench flats 98 integrally formed at the outer end of the drain plug 94 allow the plug 94 to be easily grasped and rotated into or out of sealing engagement with the valve seat 97. A vent pipe 100 is obliquely disposed in fluid communication with the end of the drain pipe 92. A threaded vent plug 102 is engageable into and out of the vent pipe 100. A screw head 103 is provided at the outer end of the vent plug 102 to facilitate the removal or insertion of the threaded plug 102 into the threaded interior of the vent pipe 100. A drain tube 104 is fluidly connected at its upper end to the bottom of the valve seat 97 by way of a fitting 106. In the preferred embodiment, the drain tube 104 is formed from stainless steel, and is housed in a side groove 108 provided along the inner surface of the wall 56 of the outer container 18. As is most easily seen in FIG. 4B, the lower open end 109 of the drain tube 104 is disposed in a bottom groove 110 which extends through the shallowly conical floor 112 of the outer container 18.

In operation, the vent, purge, and drain assembly may be used to vent the interior of the outer container 18 by removing the vent plug 102 from the vent pipe 100, screwing an appropriate fitting (not shown) into the threaded vent pipe 100 in order to channel gases to a mass spectrometer, and simply screwing the conical end 96 of the drain plug 94 out of sealing engagement with the valve seat 97. If drainage is desired, the drain plug 94 is again removed. A suction pump is connected to the drain pipe 92 in order to pull out, via drain tube 104, any liquids which may have collected in the bottom groove 110 of the conical floor 112 of the outer container 18. Gas purging is preferably accomplished after draining by removing the vent plug 102, and connecting a source of inert gas to the drain pipe 92. The partial vacuum within the container 18 that was created by the suction pump encourages inert gas to flow down through the drain tube 104. Although not specifically shown, the interior of the drain plug 98 may be provided with one or more rupture discs to provide for emergency pressure relief in the event that the cask assembly 1 is exposed to a source of intense thermal radiation, such as a fire, over a protracted period of time.

The closures 13 used in connection with the cask 1 may be either screw-type double-lidded closures 115a, 115b (illustrated in FIG. 3), or breech-lock double-lidded closures 117a, 117b (illustrated in FIG. 5).

With reference now to FIG. 3, each of the screw-type closures 115a, 115b includes an outer lid 120a, 120b, and an inner lid 122a, 122b. The inner lid 122a, 122b in turn includes an outer edge 124a, 124b which is seatable over a ledge 126a, 126b provided around the opening 128a, 128b of the shield insert 22 or the outer container 18 respectively. A gasket 130a, 130b circumscribes the outer edge 124a, 124b of each of the inner lids 122a, 122b of the two closures 115a, 115b. In the preferred embodiment, these gaskets 130a, 130b are formed of Viton because of its excellent sealing characteristics and relatively high temperature limit (392° F.) compared to other elastomers. The gasket 130a, 130b of each of the inner lids 122a and 122b is preferably received and held within an annular recess (not shown) that circumscribes the outer edge 124a, 124b of each lid. Each of these gaskets 130a, 130b is capable of effecting a fluid-tight 360. seal between the outer edge 124a, 124b of each of the inner lids 122a, 122b and the ledges 126a, 126b. To facilitate the insertion of shield insert 22 into the container 18, it is important to note that the opening 128b of the container 18 is at least as wide as the interior of the container 18 at all points.

Each of the outer lids 120a, 120b of the screwtype closures 115a, 115b includes a threaded outer edge 134a, 134b which is engageable within a threaded inner edge 136a, 136b that circumscribes the openings 128a, 128b of the shield insert 22 and the outer container 18 respectively. Swivel hooks 137a, 137b (indicated in phantom) may be detachably mounted to the centers of the outer lids 120a, 120b to facilitate the closure operation. Finally, both of the outer lids 120a, 120b of the screw-type closures 115a, 115b includes a plurality of sealing bolts 138a–h, 139a–h, threadedly engaged in bores extending all the way through the outer lids 120a, 120b for a purpose which will become apparent shortly.

To seal the cask assembly 1, inner lid 122a is lowered over ledge 126a of the shield insert 22 so that the gasket 130 is disposed between the outer edge 124a of the inner lid 122a and ledge 126a. The detachably mountable swivel hook 137 is mounted onto the center of the outer lid 120a. The outer lid 120a is then hoisted over the threaded inner edge 136a of the shield insert 22. The threaded outer edge 134a of the outer lid 120a is then screwed into the threaded inner edge 136a to the maximum extent possible. The axial length of the screw threads 134a and 136a are dimensioned so that, after the outer lid 120a is screwed into the opening 128a to the maximum extent possible, a gap will exist between the inner surface of the outer lid 120a and the outer surface of the inner lid 122*a*. Once this has been accomplished, the securing bolts 138*a–h* are each screwed completely through their respective bores in the outer lid 120*a* so that they come into engagement with the inner lid 122*a*, thereby pressing the gasket 130*a* and into sealing engagement between the ledge 126*a* and the outer edge 124*a* of the lid 122*a*. The particulars of this last step will become more apparent with the description of the operation of the breech-lock double-lidded closures 117*a*, 117*b* described hereinafter. To complete the closure of the cask assembly 1, the outer screw-type closure 115*b* is mounted over the opening 128*b* of the outer container 18 in precisely the same fashion as described with respect to the opening 128*a* of the shield insert 22.

With reference now to FIGS. 5, 6A, and 6B, the breech-lock double-lidded closure 117*a*, 117*b* also includes a pair of outer lids 140*a*, 140*b* which overlie a pair of inner lids 142*a*, 142*b* respectively. Each of the inner lids 142*a*, 142*b* likewise includes an outer edge 144*a*, 144*b* which seats over a ledge 146*a*, 146*b* that circumscribes the opening 148*a*, 148*b* of the shielding insert 23 and outer container 18, respectively. Each of the outer edges 144*a*, 144*b* is circumscribed by a gasket 150*a*, 150*b* for effecting a seal between the edges 144*a*, 144*b* and their respective ledges 146*a*, 146*b*. Like opening 128*b*, opening 148*b* is at least as wide as the interior of the outer container 18.

Thus far, the structure of the breech-lock double-lidded closures 117*a*, 117*b* has been essentially identical with the previously described structure of the screw-type double-lidded closures 115*a*, 115*b*. However, in lieu of the previously described screw threads 134*a*, 134*b*, the outer edges 154*a*, 154*b* of each of the outer lids 140*a*, 140*b* are circumscribed by a plurality of uniformly spaced arcuate notches 156*a*, 156*b* which define a plurality of arcuate flanges 158*a*, 158*b*. Similarly, the inner edges 160*a*, 160*b* which circumscribe each of the openings 148*a*, 148*b* of the shield insert 23 and outer container 18, respectively, include notches 162*a*, 162*b* which also define arcuate flanges 164*a*, 164*b*. The flanges 158*a*, 158*b* which circumscribe each of the outer lids 140*a*, 140*b* are dimensioned so that they are insertable through the arcuate notches 162*a*, 162*b* which circumscribe the inner edges 160*a*, 160*b* of the shield insert 23 and the outer container 18. As may best been seen in FIG. 6A and 6C, such dimensioning allows the flanges 164*a*, 164*b* of each of the outer lids 140*a*, 140*b*, to be inserted through the notches 162*a*, 162*b* of each of the openings 148*a*, 148*b* and rotated a few degrees to a securely locked position wherein the arcuate flanges 158*a*, 158*b* of the outer lids 140*a*, 140*b* are overlapped and captured by the arcuate flanges 164*a*, 164*b* that circumscribe the inner edges 160*a*, 160*b*. It should be further noted that the axial length L1 (illustrated in FIG. 6B) of the interlocking flanges 158*a*, 158*b* and 164*a*, 164*b* is sufficiently short to leave a small gap L2 between the inner surface of the outer lids 140*a*, 140*b* and the outer surface of the inner lids 142*a*, 142*b*. The provision of such a small distance L2 between the outer and inner lids allows the outer lids 140*a*, 140*b* to be rotated a few degrees into interlocking relationship with their respective notched inner edges 160*a*, 160*b* without transmitting any rotary motion to the inner lids 142*a*, 142*b* which could cause the inner lid gaskets 150*a*, 150*b* to scrape or wipe across their respective ledges 146*a*, 146*b*.

Connected around the outer edges of the outer lids 140*a*, 140*b* are three suspension pin assemblies 166*a*, 166*b*, and 166*c* and 167*a*, 167*b*, and 167*c* (not shown) respectively. Each of these suspension pin assemblies 166*a*, 166*b*, 166*c* and 167*a*, 167*b*, 167*c* are uniformly spaced 120° apart on the edges of their respective outer lids 140*a*, 140*b*. As the structure of each suspension pin assembly is the same, only a suspension pin assembly 166*a* will be described.

With reference now to FIG. 6C, suspension pin assembly 166*a* includes a suspension pin 168 which is slideably movable along an annular groove 170 provided around the circumference of each of the inner lids 142*a*, 142*b*. A simple straight-leg bracket 172 connects the suspension pin 168 to the bottom edge of its respective outer lid.

In operation, the suspension pin assemblies 166*a*, 166*b*, 166*c* and 167*a*, 167*b*, 167*c*, serve two functions. First, the three suspension pin assemblies attached around the edges of the two outer lids 140*a* and 140*b* mechanically connect and thus unitize the inner and outer lids of each of the breech-lock closures 117*a*, 117*b* so that both the inner and the outer lids of each of the closures 177*a* and 117*b* may be conveniently lifted and lowered over its respective opening 148*a*, 148*b* in a single convenient operation. Secondly, the pin-and-groove interconnection between the inner and the outer lids of each of the two breech-lock type closures 117*a* and 117*b* allows the outer lids 140*a* and 140*b* to be rotated the extent necessary to secure them to the notched outer edges 160*a*, 160*b* of their respective containers without imparting any significant amount of torque to their respective inner lids 142*a*, 142*b*. This advantageous mechanical action in turn prevents the gaskets 150*a* and 150*b* from being wiped or otherwise scraped across their respective ledges 146*a*, 164*b*. In the preferred embodiment, the width of the groove 170 is deliberately made to be substantially larger than the width of the pin 168 so that the pin 168 may avoid any contact with the groove 170 when the outer lids 140*a*, 140*b* are rotated into interlocking relationship with their respective containers 23 and 18.

With reference again to FIG. 6A and 6C, each of the outer lids 140*a*, 140*b* includes eight sealing bolts 174*a–h*, 174.1*a–h* equidistantly disposed around its circumference. Each of these sealing bolts 174*a–h*, 1741*a–h* is receivable within a bore 175 best seen in FIG. 6C.

Each of these bores 175 includes a bottom-threaded portion 176 which is engageable with the threads 176.1 of its respective bolt 174*a–h*, 174.1*a–h* as well as a centrally disposed, non-threaded housing portion 177. At its upper portion the bore 175 includes an annular retaining shoulder 178 which closely circumscribes the shank 179 of its respective bolt 174*a–h*, 1741*a–h*. The retaining shoulder 178 insures that none of the sealing bolts 174*a–h*, 174.1*a–h* will inadvertently fall out of its respective bore 175 in the outer lid 140*a*, 140*b*. In operation, each of the sealing bolts 174*a–h* is screwed upwardly into its respective bore 175 until its distal end 179.1 is recessed within the threaded portion 176 of the bore 175. After the outer lid 140*a* or 140*b* has been secured into the notched inner edge 160*a* or 160*b* of its respective container 23 or 18, the sealing bolts 174*a–h* are screwed down into the position illustrated in FIG. 6C until their distal ends 179.1 forcefully apply a downward-direction force around the outer edges 144*a*, 144*b* of their respective inner lids 142*a*, 142*b*. Such a force presses the gaskets 150*a* and 150*b* into sealing engagement against their respective ledges 146*a*, 146*b*. It should be noted that the same bolt and bore configuration as heretofore described is utilized in the screw-type double-lidded closures 115*a*, 115*b*.

To insure that the outer lids 140*a* and 140*b* will not become inadvertently rotated out of locking engagement with their respective vessels 23 or 18, a locking bracket 180 is provided in the position illustrated in FIG. 6A and 6B in each of the outer lids 140*a*, 140*b* after they are rotated shut. Each locking bracket 180 includes a lock leg 182 which is slid through mutually registering notches 156*a*, 156*b*, and 162*a*, 162*b* after the outer lids 140*a* and 140*b* have been rotated into locking engagement with the inner edges 160*a*, 160*b* of either the shielding insert 23 or the outer container 18. In the case of outer lid 140*b*, the mounting leg 184 is secured by means of locking nuts 186*a*, 186*b*. In the case of outer lid 140*a*, the mounting leg 184 is captured in place by inner lid 142*b* which abuts against it. Although not specifically shown in any of the drawings, each of the outer lids 120*a*, 120*b* of the screw-type double-lidded closures 115*a*, 115*b* is similarly secured. However, instead of a locking bracket 180, a locking screw (not shown) is screwed down through the outer edges of each of the outer lids 120*a*, 120*b* and into a recess precut in each of the inner lids 122*a*, 122*b*.

I claim:

1. An improved cask assembly for forming a cask for transporting a radioactive material of a particular activity, comprising an outer container having an opening leading to its interior, and a plurality of integrally formed inner shield inserts, each of which includes an interior of receiving waste, an a continuous exterior wall whose shape is substantially complementary to the shape of the interior of the outer container and which is insertable therein to completely fill said interior and to form the cask, the walls of said inner shield inserts being of different thicknesses and different materials, wherein the particular shield insert placed within the interior of the outer container is chosen to match the intensity and type of radiation emitted by the material to be transported so that the surface radiation of the resulting cask does not exceed a preselected intensity when the interior of an insert is completely filled with radioactive material of said particular activity.

2. The improved cask assembly defined in claim 1, wherein the opening of the outer container is at least as wide as the interior thereof to facilitate the insertion of the shield insert within the outer container.

3. The improved cask assembly defined in claim 1, wherein at least one of said inner shield inserts includes a layer of lead.

4. The improved cask assembly defined in claim 1, wherein at least one of said inner shield inserts includes a layer of depleted uranium.

5. The improved cask assembly defined in claim 1, further including a closure means for closing and sealing said outer container, wherein the outer edge of the closure means is circumscribed by screw threads that are engageable with screw threads present around said opening in said container.

6. The improved cask assembly defined in claim 1, further including a closure means for closing and sealing said outer container, wherein an outer portion of the closure means includes at least one notch for defining a flange which is interlockable with a notch and flange present around said opening in said container.

7. The improved cask assembly defined in claim 1, further including a vent, purge, and drain assembly mounted in a side wall of the outer container for venting, purging, and draining said container.

8. The improved cask assembly defined in claim 7, wherein said vent, purge, and drain assembly includes a drain pipe present in said side wall of said outer container, and a drain tube means fluidly connected to said drain pipe at one end and the bottom of said outer container at the other end.

9. The improved cask assembly defined in claim 8, wherein said vent, purge, and drain assembly further includes a vent pipe in said side wall of the outer container that communicates with said drain pipe, and first and second plug means for plugging said drain and vent pipes respectively.

10. The improved cask assembly defined in claim 1, wherein said insert is cylindrical in shape, and wherein the thicknesses of the wall of the shield insert is chosen to minimize the radial distance between the shielding material in the wall and the radioactive material being transported.

11. The improved cask assembly defined in claim 1, wherein said insert is cylindrical in shape, and wherein the thicknesses of the wall of the shield insert is chosen to minimize the radial distance between the shielding material in the wall and the radioactive material being transported.

12. An improved cask assembly for forming a cask for transporting a radioactive material of a particular activity, comprising an outer container having an opening circumscribed by a ledge that affords access to the interior of the container, and a plurality of integrally formed shield inserts, each of which includes an interior for receiving waste, ad a continuous exterior wall whose shape is substantially complementary to the shape of the interior of the outer container and which is insertable therein to completely fill said interior to form the cask, the walls of said inner shield inserts being of different thicknesses and including different shield materials, wherein the shielding properties of the particular shield inserted within the interior of the outer container is chosen to match the intensity and type of radiation emitted by the material to be transported so that the surface radiation of the resulting cask does not exceed a preselected intensity when the interior of an insert is completely filled with a particular type of radioactive material, and first and second closure means for separately closing and sealing the outer container and the shield insert disposed in said container, respectively.

13. The improved cask assembly defined in claim 12, wherein the predominant shielding material of one of said inner shield inserts is lead.

14. The improved cask assembly defined in claim 12, wherein the predominant shielding material of another of said inner shield inserts is depleted uranium.

15. The improved cask assembly defined in claim 12, wherein the outer container includes an inner layer of a shielding material containing boron in a silicone matrix.

16. The improved cask assembly defined in claim 12, wherein the opening of the outer container is at least as wide as the interior thereof to facilitate the insertion of a shield insert therein.

17. The improved cask assembly defined in claim 12, wherein the shielding material of each insert is laminated between sheets of stainless steel, and wherein the interior of the outer container is lined with stainless steel.

18. The improved cask assembly defined in claim 12, wherein the outer edge of the first closure means is circumscribed by screw threads that are engageable with screw threads present around said opening in said container.

19. The improved cask assembly defined in claim 16, wherein an outer portion of the first closure means includes at least one notch for defining a flange which is interlockable with a notch and flange present around said opening in said container.

20. The improved cask assembly defined in claim 12, wherein the bottom end of the outer container has a tapered floor for collecting liquids.

21. An improved cask assembly for forming a cask for transporting a radioactive material of a particular activity comprising a. an outer container having an opening circumscribed by a ledge that affords access to the interior of the container, wherein the minimum cross sectional area of the opening is at least as large as the mouth of the interior so that said opening does not impede the entry through said mouth;

b. a closure means for closing and sealing said outer container, including a first lid means that is sealable over said ledge circumscribing said opening, a second lid means that is mountable around said opening over said first lid means without the application of torque to said first lid means;

c. a vent, purge, and drain assembly including a drain pipe in the side wall of the outer container, a drain tube means fluidly connected to the drain pipe at one end and to the bottom of the interior of the outer container at the other end, and a vent pipe in said side wall of said outer container, and first and second means for plugging said vent and drain pipes, respectively, and d. a plurality of integrally formed shield inserts, each of which includes an interior for receiving radioactive material a continuous exterior wall whose shape is substantially complementary to the shape of the interior of the outer container and which is insertable therein to completely fill said interior and to form the cask, the walls of said inner shield inserts being of different thicknesses and including different shield materials, wherein the shielding properties of the particular shield inserted within the interior of the outer container are chosen to match the intensity and type of radiation emitted by the material to be transported so that the surface radiation of the resulting cask does not exceed a preselected intensity, and wherein the thickness of the walls of the shield insert is chosen so that the shielding material contained therein directly abuts the radioactive material within the insert to minimize the total weight of the shielding material used in the insert.

* * * * *